United States Patent [19]

Lesher

[11] Patent Number: 4,931,173

[45] Date of Patent: Jun. 5, 1990

[54] APPARATUS AND METHOD FOR REMOVING DEBRIS FROM GRANULAR MATERIAL

[76] Inventor: Thomas Lesher, 1615 Avenue E, Kearney, Nebr. 68847

[21] Appl. No.: 205,225

[22] Filed: Jun. 10, 1988

[51] Int. Cl.[5] ..... B07B 4/02

[52] U.S. Cl. ..... 209/138; 209/150; 414/291

[58] Field of Search ..... 209/132–139.1, 209/145, 146, 149, 150, 154; 414/291

[56] References Cited

U.S. PATENT DOCUMENTS

| | | | |
|---|---|---|---|
| 854,757 | 5/1907 | Peacock | 209/138 X |
| 997,372 | 7/1911 | Cornwall | 209/139.1 |
| 1,650,727 | 11/1927 | Stebbins . | |
| 1,914,862 | 6/1933 | Menk | 209/150 |
| 2,329,900 | 9/1943 | Hermann | 209/139.1 |
| 2,766,880 | 10/1956 | Schaub et al. | 209/138 |
| 2,931,500 | 4/1960 | Andrew et al. . | |
| 2,950,006 | 8/1960 | Forsberg | 209/138 |
| 3,306,443 | 2/1967 | Sereno et al. | 209/136 |
| 4,465,194 | 8/1984 | Coleman . | |
| 4,554,067 | 11/1985 | Arimitsu . | |
| 4,568,453 | 2/1986 | Lowe, Jr. | 209/149 X |

FOREIGN PATENT DOCUMENTS

| | | | |
|---|---|---|---|
| 0518309 | 11/1955 | Canada | 209/138 |
| 1031097 | 5/1958 | Fed. Rep. of Germany | 209/138 |
| 0093138 | 11/1958 | Norway | 209/138 |

*Primary Examiner*—Margaret A. Focarino
*Assistant Examiner*—Edward M. Wacyra
*Attorney, Agent, or Firm*—Bernard L. Kleinke; William Patrick Waters; Jerry R. Potts

[57] ABSTRACT

An apparatus and method for removing debris from granular material, utilizes a pair of inner and outer ducts, which are separated by an air chamber for guiding and discharging a backward flow of air under pressure through a passageway opening extending between the two ducts. The air pressure flows through flowing granular material as it moves along a given path from the first duct into the second duct. A spreader member guides the flow of material into an opening between the edge of the spreader and the wall of the outer duct. A porous member disposed downstream of the spreader member near the opening receives the material flowing through the opening and is inclined from the wall toward the central axis of the outer duct, as the air flows backwardly through the porous member.

14 Claims, 1 Drawing Sheet

APPARATUS AND METHOD FOR REMOVING DEBRIS FROM GRANULAR MATERIAL

DESCRIPTION

1. Technical Field

This invention relates to the general field of separators and a method for removing lightweight debris from heavier granular material. More particularly, the present invention relates to an apparatus and a method of cleaning light weight debris particles from a heavier granular material, such as grain.

2. Background Art

There have been many different types and kinds of separators and methods for removing or cleaning lighter debris particles from heavier particles. For example, reference may be made to the following U.S. Pat. Nos.: 1,650,727; 2,766,880; 2,931,500; 4,465,194; and 4,554,067.

While such prior known devices may have been successful for some applications, it has been difficult, if not impossible, to separate lighter particles from heavier particles, such as debris from grain, in a highly efficient manner, without damaging the grain. In this regard, for example, in the U.S. Pat. No. 2,766,880, there is shown a separator having a perforated bottom wall for permitting air under pressure to be blown therethrough against the downward flow of particles to remove entrained debris therefrom. However, the resulting violent turbulent action, can cause damage to the particles to be cleaned. In this regard, the light-weight debris is blown under great force against the stream of particles entering the separator, thereby causing the heavier particles, such as grain, to be driven forcefully against the walls of the separator and against each other. As a result, the particles to be cleaned can become damaged.

Therefore, it would be highly desirable to have a new and improved apparatus and method for separating lighter particles from heavier particles in a more efficient and cost effective manner, with little or no damage to the heavier particles.

Separators, and more particularly pneumatic type separators, have been used in the past for cleaning debris from heavier particles. Such devices have generally required large fans with sufficient horsepower to produce the necessary dynamic forces to separate effectively the lighter particles from the heavier particles. Moreover, some granular materials by reason of their weight require a greater dynamic force to effect the separation. Therefore, large housing units have generally been required to accommodate the fans and motors necessary to generate such dynamic forces.

Therefore, it would be highly desirable to have a new and improved method and apparatus for performing the desired separation in a highly efficient and effective manner, without requiring the use of bulky and expensive fans and motors, or the expenditure of excessively large amounts of energy.

Separators in the past have also served as means for helping dry grain and other granular materials that have become wet. Such apparatus have generally required special large fans and spreading devices such as conveyors and the like, to expose and dry the wet material effectively. Therefore, it would be highly desirable to have a new and improved apparatus for particle separation as well as being able to be adapted to help dry wet granular material without the need of special fans, conveyors or the like, and that would be highly efficient and cost effective.

DISCLOSURE OF INVENTION

Therefore, it is the principal object of the present invention to provide a new and improved separation apparatus and method for removing light weight debris from granular material in a simple and effective manner.

Another object of the present invention is to provide such a new and improved separation apparatus and method to cause particle separation with little or no damage to the heavier particles to be cleaned.

Another object of the present invention is to provide such a new and improved separation apparatus and method of a highly effective and cost efficient manner.

Briefly, the above and further objects of the present invention are realized by providing a new and improved separation apparatus and method for removing light weight debris from a granular material by separating lighter articles from heavier articles in a highly efficient manner, with little or no damage to the particles to be cleaned.

The apparatus for removing the debris from the granular material includes a base for receiving a large volume of air flow from an air flow source. Mounted on top the base, is a duct defining a passageway for the flow of granular material to be cleaned in one direction and an air flow in the opposite direction. At one end of the duct is an inlet for directing and guiding the granular material into the duct. At the opposite end of the duct is an outlet for collecting and guiding the cleaned granular material out of the duct. A conical shaped spreader disposed in the center of the duct divides the duct into a primary chamber and a secondary chamber and spreads the flow of the granular material as it is directed against the apex center of the spreader then away towards the interior peripheral wall of the duct.

An annular guide screen is mounted on the interior peripheral wall of the duct near the terminal edge of the spreader and on an inclined plane with its lower terminal end disposed nearer the longitudinal center axis of the duct than its upper terminal end. The screen covers an opening through which a high velocity stream of air flows from the base in an opposite direction from the flow of granular material, to discharge the lighter entrained particles from the heavier articles in the flow of granular material. The screen is sufficiently small to substantially prevent the granular material from passing through the openings in the screen. As the flow of material passes over the screen surface, the inclined angle of the screen directs the flow of the granular material to be cleaned toward the interior peripheral wall of the duct and into a secondary chamber. The secondary chamber is disposed adjacent to the interior peripheral wall of the duct, having an opening at one end that extends along the periphery of the duct. The opposite end of the chamber terminates in the outlet of the duct for permitting the cleaned granular material to be guided out of the duct.

A channel defined by the interior peripheral wall of the duct and the interior wall of the chamber is covered by the inclined screen and is in atmospheric communication with the interior cavity of the base so that the air stream directed into the base flows out of the base and into the channel. An opening in the duct in the primary chamber permits the stream of air flow discharged from the channel into the primary chamber to escape from the duct into the atmosphere.

The method of separating the lighter articles from the heavier articles is achieved by directing a flow of granular material having heavier and lighter articles into a duct and against a conically shaped spreader. The spreader directs the flow of material along its surface and away from the longitudinal center of the duct to fall in a stream as it exits the terminal edge of the spreader. When the granular material reaches the terminal edge of the spreader, the material flows into an opening and against a screen that reverses the flow of the granular material away from the interior wall of the duct and toward the center of the duct. As the granular material traverses from the spreader to the screen, the material flows through a concentrated air stream under pressure flowing in the opposite direction to provide a sufficient force to separate the lighter weight particles from the heavier weight particles, but not of sufficient force to inhibit the general flow of the heavier particles which continues their flow path against the screen and along the surface of the screen. As the lighter articles are separated, they become air borne in the primary chamber only and are discharged through an opening in the duct wall disposed in the primary chamber.

As a result of having such an arrangement and separation method, the cleaned particles flow past the screen and into the quiescent zone, so that the cleaned particles do not sustain unwanted damage.

BRIEF DESCRIPTION OF DRAWINGS

The above mentioned and other objects and features of this invention and the manner of attaining them will become apparent, and the invention itself will be best understood by reference to the following description of an embodiment of the invention in conjunction with the accompanying drawings, wherein.

BEST MODE FOR CARRYING OUT THE INVENTION

Figure 1:
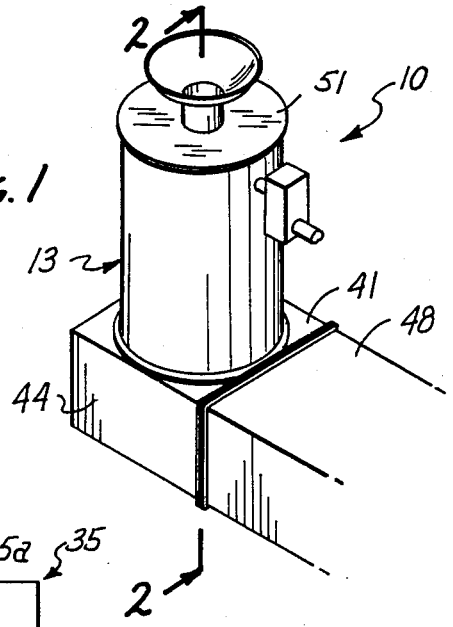
FIG. 1 is a fragmentary pictorial view of an apparatus for removing debris from granular material, which apparatus is constructed in accordance with the present invention.
Figure 2:
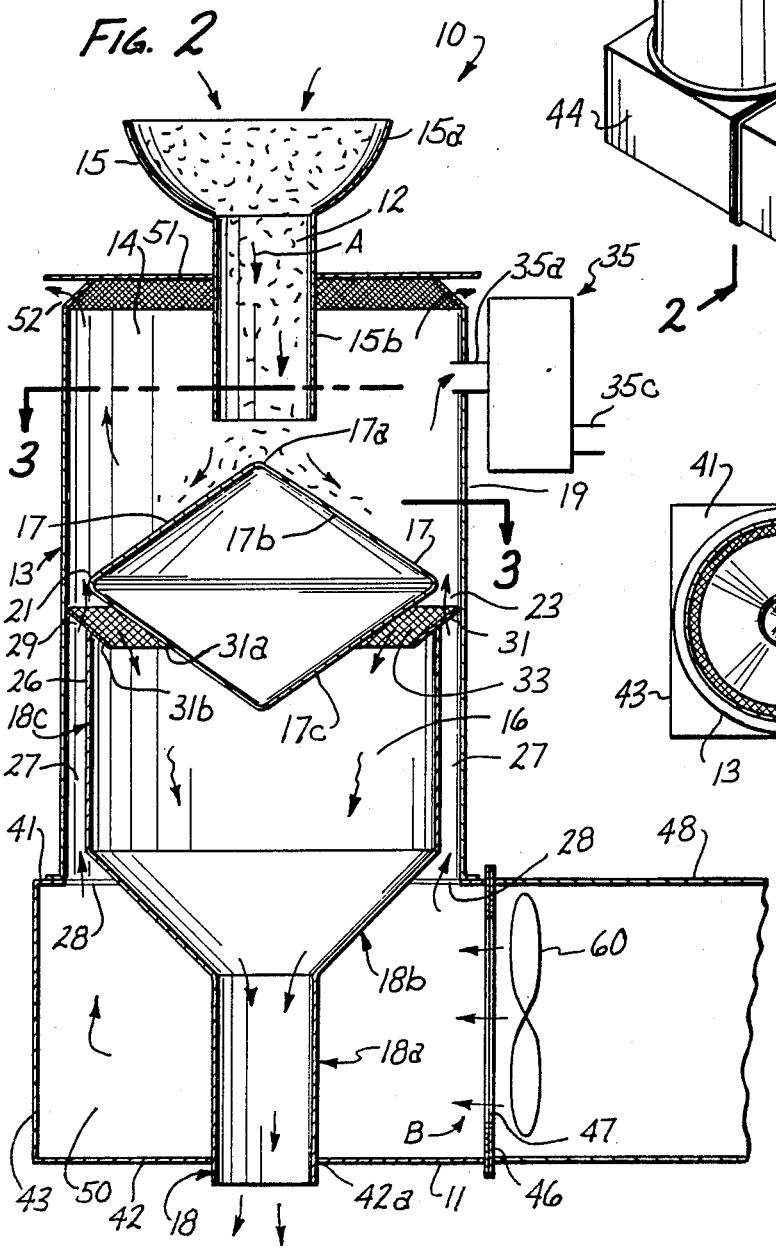
FIG. 2 is an enlarged sectional, partly schematic, elevational view of the apparatus for removing debris from granular material of FIG. 1 taken substantially on line 2—2 thereof.

Referring now to the drawings, and more particularly to FIGS. 1 and 2, there is shown an apparatus 10 for removing debris from granular material, which apparatus is constructed in accordance with the present invention.

The apparatus 10 generally comprises a base 11 for supporting from below, an upright duct or vessel 13, defining a generally vertical passageway for the continuous flow of granular material 12 (FIG. 2), in one downward direction (the direction of the arrows A). An inlet 15 disposed at the upper end of the duct 13 guides the flow of the granular material into the center of duct 13. An outlet 18 disposed at the opposite bottom end of the duct 13 guides the flow of the granular material out of duct 13. A spreader 17 disposed in the central portion of the duct divides it into a primary chamber, and a secondary chamber, and spreads and guides the flow of material into a cascading sheet away from the center of the duct toward an inner peripheral wall 19 of the duct and toward a terminal end edge 21 of the spreader. An opening 23 between the inner peripheral wall and the terminal edge of the spreader permits and guides the flow of material into an upwardly flowing stream of air under pressure through an opening in a direction opposite to the flow of the material. A channel receives the flow of material after it cascades downwardly under the force of gravity through the opening 23 and guides the flow of material into the secondary chamber. An annular channel 27 receives and directs the stream of air along the peripheral wall 19 of the duct 13, terminating at one end in an opening 28 disposed in base 11 and at its opposite end, in an opening 29 disposed in the space defining the opening 23.

An annular screen 31 disposed between the inner peripheral wall of the duct and the chamber wall, over the annular opening 29 substantially prevents the flow of material from entering the channel 27 as the material cascades through opening 23. Moreover, the screen 31 guides the flow of material as it traverses along an upper surface 33 of the screen away from the inner peripheral wall of the duct and toward the longitudinal center vertical axis of chamber 16. An annular outlet generally indicated at 52 (FIG. 2) disposed in a side wall 19 of the duct above the spreader in the primary chamber for permitting the light weight debris separated from the material flow as it passes through the air stream to be discharged through this annular outlet or passage 52 into the atmosphere.

In operation, a stream of air is guided into the base 11 via a duct 48 (FIG. 1) by a fan 60 (FIG. 2). From there, the air under pressure flows through opening 28, through channel 27, out opening 29 into the duct 13, and from there through the debris exit passage 35 into the atmosphere or other receptacle (not shown) for collecting debris. A flow of granular material is directed in the opposite direction of the air stream, and flows into the duct 13 through the inlet 15, against the spreader 17, through opening 23 against screen 31, then into chamber 25 and out of the duct 13 through the outlet 18. As the flow of granular material is dispersed by spreader 17, the material cascades and falls under the force of gravity in a sheet through the opening 23 and through the upwardly directed air stream to permit the lighter weight particles in the material to be separated and discharged upwardly into the primary chamber 14 and out of the duct 13 through the exit passage 35.

Figure 3:
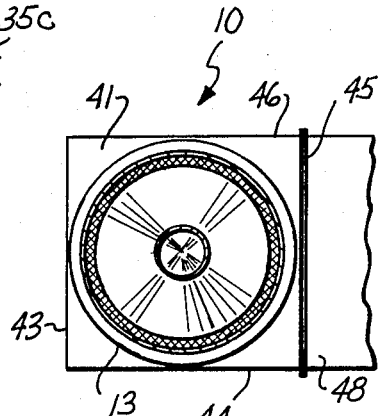
FIG. 3 is an enlarged fragmentary sectional elevational view of the apparatus of FIG. 1 taken substantially on line 3—3 of FIG. 2.

Referring now to FIGS. 2 and 3, the method of removing debris from the granular material to be cleaned will now be described in greater detail. In operation, as shown in FIGS. 2 and 3, an operator using apparatus 10, commences operation by activating the fan 60. The fan 60 generates a high volume flow of air under pressure which is directed horizontally into an interior cavity 50 of base 11. The flow of the air from fan 60 into the cavity 50 is shown by the horizontal arrows in FIG. 2. A top surface 41 of the base 11 has the annular opening 28 to permit the air in cavity 50 to be accelerated rapidly as it passes through the opening 28 into a channel 27 located in the lower portion of the duct 13. This air stream travels through the length of the vertical channel 27 and exits at its terminal upper end defining an opening 29.

The opening 29 is covered with the fine mesh screen 31 that permits the air stream to flow from the channel 27 and into the opening 29 for the primary chamber of the duct 13. The spreader 17 is disposed in the duct 13 so that its terminal end edge divides the duct 13 into two chambers, the primary chamber 14 and the secondary chamber 16. The distance between the terminal edge 21 of the spreader 17 and the peripheral wall 19 of the duct defines the opening 29 that permits the air flow from the channel 27 to continue its path of flow into the primary chamber 14. The vacuum pump 35 has its inlet 35A connected in fluid communication with the interior of the duct 13 to draw air out of chamber 14 and discharge it from its outlet 35C into the atmosphere. The vacuum pump assists to withdrawal of the debris entrained in the upwardly flowing air.

When the fan has been activated, the operator activates the vacuum pump 35 to assist in discharging the air stream through the outlet 35C. It should be understood that the air stream discharged in chamber 14 also exits through the upper annular outlet 52 without the use of the vacuum pump, because of the air stream under pressure created by the fan 60.

When both the fan and the vacuum pump have been activated, a flow of granular material is directed by the operator into the upper portion 15A of inlet 15. As this material flows therein, the material falls under the force of gravity into a reduced diameter lower portion 15B of the inlet which restricts and inhibits the stream flow as the diameter of the lower portion 15B is smaller than the diameter of the upper portion 15A of the inlet.

The material then drops out of the lower terminal end of inlet 15 and is directed against an apex 17A of the spreader 17. Spreader 17 is generally conically shaped so that the flow of material is cascaded down its sloping surface to form effectively a flowing sheet of material that falls off the terminal edge 21 of the spreader. The slope angle of the surface of spreader 17 further inhibits the flow of the material as it transverses along the surface of the spreader.

When the material drops off of the terminal end edge 21 of the spreader 17 the material falls through opening 29 and against the screen 31. As the material is falling onto the screen 31, the upwardly directed air stream flows through channel 27 to blow the debris entrained in the falling material 12 to be cleaned. The operator is able to control the fan speed of the fan 60 so as to assume that the generated air stream traveling out of channel 27 is adjusted to enable the heavier granular particles to continue their flow against the screen 31, while the lighter weight particles are dislodged from the material stream and are blown back into the primary chamber 14, without entering the secondary chamber 16.

The screen 31 substantially prevents the flow of material from entering the channel 27. As the light weight particles are blown into the upper chamber 14, the particles are discharged with the air flow as it exits from the duct 13 through the annular passage 52 into the atmosphere.

When the heavier weighted materials fall into engagement with the screen 31, the material to be cleaned continue to fall into the channel 33 between the screen 31 and the spreader 17. The flow is guided radially inwardly so that the material flows away from the peripheral wall 19 toward the central longitudinal axis of duct 13. The cleaned granular material falls from the bottom edge 31A of the annular screen 31 at the lowermost portion of the channel 33, and into the outlet 18, where the cleaned material is discharged into a storage unit (not shown).

Considering now base 11 in greater detail with reference to FIGS. 1 and 2, the base 11 is generally an integrally formed smooth flat body section of uniform cross section defined by a bottom 42, four side walls 43, 44, 45, and 46 extending upwardly and perpendicularly to the bottom wall 42 and that terminate in a top wall 41. Wall 46 has an opening 47 and is adapted to be mounted to a fan housing 48 that encloses the fan 60 for directing and guiding the air stream through the opening 47 and into the base 11.

The opening 28 at the bottom of the duct 13 permits air flow to travel from the interior cavity 50 of the base 11 and into the vertical interior of the duct 13. An outlet 18 is adapted to be received within a hole (not shown) located in the center of top surface 41.

Considering now outlet 18 in greater detail with reference to FIG. 2, the outlet 18 is generally an integrally formed smooth hollow funnel of varying cross section, having a lower portion 18A, a mid portion 18B and an upper portion 18C. The lower portion 18A is tubular and extends through a hole 42A (FIG. 2) in the bottom wall 42 of base 11. The mid portion 18B is conical in shape and extends through the opening 28 at the bottom of the duct 13. The upper portion 18C is tubular and has a diameter which is substantially greater than the diameter of the lower portion 18A of outlet 18. The wall 26 of upper portion 18C extends upwardly and perpendicularly to the top wall 41 and parallel to the peripheral wall 19 of the duct 13 defining the annular channel 27 terminating at the upper terminal edge of the wall 26. In this manner, the air flow that is directed into the interior cavity 50 of the base 11 travels into the duct 13 via the opening 28 and is confined to channel 27 as it passes through the secondary chamber 16.

Considering now the duct 13 in greater detail with reference to FIGS. 1 and 2, the duct 13 is generally cylindrical in shape and hollow throughout its axial length. It has a uniform cross section being cylindrical in shape. Duct 13 is secured to the top wall 41, and extends upwardly and perpendicularly from the top wall 41 terminating in a top wall 51.

Considering now inlet 15 in greater detail, inlet 15 is generally funnel shaped and is hollow throughout its axial length. It has a top portion 15A and a bottom portion 15B. The top portion 15A is cup shaped for receiving and temporarily holding a quantity of granular material. The bottom portion 15B is tubular in shape having a diameter substantially smaller than the diameter of the upper portion 15A. In this manner, the lower portion 15B of inlet 15 guides the flow of the granular material received in the top portion 15A as the flow traverses into the duct 13 through the bottom portion 15B.

Considering now in greater detail the spreader 17, the spreader 17 is mounted by means (not shown), to the duct 13 approximately at midpoint of the interior thereof between the top surface 51 of the duct 13 and the top wall 41 of base 11. Spreader 17 has an upper conical portion 17B and a lower conical portion 17C. The upper portion 17B is an inverted V-shaped in cross section, and the lower portion 17C is V-shaped in cross section. The upper portion 17B and the lower portion 17C are similar to one another and only the upper portion 17A will now be described in greater detail.

The upper portion 17B is conically shaped extending downwardly from its apex 17A at an approximate angle of approximately 45° terminating in a terminal edge 21, which is disposed adjacent to the wall 19, and which is connected fixedly by suitable means (not shown) such as by welds ground down, to the upper edge of the lower portion 17C. The annular space 23 extends between the terminal edge of the spreader 17 and the wall 19. With this relation, the flow of granular material exits from the bottom portion 15B of inlet 15 and engages the apex 17A and the surrounding surface of the apex of the upper portion 17B of spreader 17. As the granular material falls, it spreads out, descends under the force of gravity along the outer surface of the upper portion 17B and cascades off the terminal edge 21 of the surface of spreader 17 in a sheetlike flow into and through the opening 23.

Considering now the opening 23 in greater detail, the opening 23 extends between the terminal edge of spreader 17 and wall 19 of duct 13. The distance between the edge 23 and the wall 19, as well as the angle of the slope for the surface of upper portion 17B of spreader 17 determines the flow rate of the granular material as it traverses between the primary chamber 14 and into the space 23. The screen 31 is mounted to wall 19 slightly below the annular space 23 and is inclined downwardly and radially inwardly at an approximate angle of 45° relative to the surface of the wall 19. The surface of screen 31 is substantially parallel to the lower portion 17B of spreader 17 and defines a channel 34 leading into the secondary chamber 16. The distance between the surface of the lower portion 17C of spreader 17 and the surface of screen 31 defining the space 33 affects the flow rate of the granular material as it traverses through the channel 34 that commences at the upper planar surface of the space 23 at one end and at the terminal edge of the lower end of screen 31 at the opposite end.

It should be understood that the dimensions of the inlet 15, the space 23 and the channel 34, as well as the slopes of the upper and lower portions of spreader 17, determined affects the rate of flow of the material through the apparatus 10. For example, it has been determined that in cleaning grain, that approximately 1400–1500 bushels of grain may be effectively and efficiently cleaned when the diameter of the space 23 and the channel 34 approximates one inch, in relation to a six inch diameter in the lower portion 15B of inlet 15 with a 45° slope for the upper and lower surfaces of spreader 17.

It should further be understood that by directing the flow of the granular material to the center of the duct 13, the path of fall for the granular material is reduced. In the process of cleansing grain, this is important as it has been determined that certain grain are damaged if agitated too violently. Accordingly, this relation prevents the grain from hitting or striking the surface of the outlet 18 too vigorously, thereby preventing, or at least greatly reducing damage to the grain kernel being cleaned.

In order to guide the cleaned material away from the inner surface of the wall 26, an extension 31B is disposed within the lower chamber 16, and is positioned in a generally parallel spaced apart manner relative to the lower portion 17C of the spreader 17. Thus, the falling material is directed toward the central vertical axis of the unit. Also, the outer surface of the lower portion 17C further facilitates guiding the material toward the central portion of the space 16 and away from the wall 26.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An apparatus for removing debris from granular material comprising:

first duct means for permitting the passage of a continuous flow of the granular material in a given path, said first duct means having a wall defining the outer periphery of said path;

means for directing the flow of the granular material into the first duct means;

means for guiding the flow of material toward the outer periphery of the first duct means;

said means for guiding including a spreader member terminating at its outer edge in a closely spaced apart relationship relative to said wall to help define an opening;

second duct means for permitting the passage of the continuous flow of the granular material in said given path;

means for guiding a continuous uninterrupted flow of air under pressure along a chamber disposed between and adjacent to both the outer periphery of said path and the second duct means and through the flow of granular material into the first duct means to remove debris contained therein;

means for permitting the reverse flow of the granular material away from the wall defining the outer periphery of the path and toward the central axis of said second duct means and for substantially preventing the granular material from entering said chamber;

said means for permitting the reverse flow, including a porous member disposed downstream of said spreader member near said opening for receiving the granular material flowing through said opening, said porous member being inclined from said wall toward said central axis, said air under pressure flowing through said porous member and then through said opening to flow in a direction opposite to the flow of material along said given path;

a rigid member disposed in a spaced apart manner relative to said porous member upstream thereof for defining with said porous member an angularly inclined channel to guide the flow of granular material toward the central axis of said second duct means along a portion of said path;

means for directing the flow of the granular material out of the second duct means; and means for directing the flow of air and airborne debris contained therein out of said first duct means.

2. The apparatus as recited in claim 1, wherein said means for guiding the flow of material toward the outer periphery of the first duct means includes a diamond shaped hollow body having an upper conically shaped surface forming the spreader member, and a lower conically shaped surface forming the rigid member.

3. The apparatus as recited in claim 2, wherein the upper conically shaped surface slopes downwardly toward the periphery of said first duct means.

4. The apparatus as recited in claim 3 wherein the downward slope of said surface is approximated between an angle of about 25° to about 65°.

5. The apparatus as recited in claim 2, wherein the lower conically shaped surface slopes downwardly toward the longitudinal center axis of said second duct means.

6. The apparatus as recited in claim 5, wherein the downward slope of said surface is approximately between an angle of about 25° to about 65°.

7. The apparatus as recited in claim 1, wherein said means for directing the flow of the granular material into the first duct means comprises a hollow body having an upper body portion and a lower body portion, said upper body portion being cup-shaped and said lower body portion being cylindrical and having a diameter smaller than the diameter of said upper body portion.

8. The apparatus as recited in claim 7 wherein the ratio between the diameter of the upper body portion and the diameter of the lower body portion is approximately 7 to 3.

9. The apparatus as recited in claim 1 wherein said porous member includes a meshed screen mounted on said first duct means, said screen being inclined downwardly and toward the longitudinal center axis of said second duct means.

10. The apparatus as recited in claim 9, wherein the screen is inclined downwardly at an angle approximated between about 25° and to about 65°.

11. The apparatus as recited in claim 1, further comprising power-operated fan means for generating the continuous uninterrupted flow of air.

12. The apparatus as recited in claim 1, wherein said means for discharging the airborne debris from the duct comprises a vacuum pump.

13. The apparatus as recited in claim 1, wherein the means for directing the flow of air and airborne debris contained therein out of the first duct means includes the peripheral wall of said first duct means, said wall having at least one hole disposed therein for permitting the egress of air and airborne debris out of said first duct means into the atmosphere.

14. A method for removing debris from granular material comprising:

using a first duct means;

permitting the passage of a continuous flow of the granular material in a given path, said first duct means having a wall defining the outer periphery of said path;

directing the flow of the granular material into the first duct means;

guiding the flow of material toward the outer periphery of the first duct means;

using a second duct means;

guiding a continuous uninterrupted flow of air under pressure along a chamber adjacent to both the outer periphery and the second duct means and through the flow of granular material into the first duct means to remove debris contained therein;

using a spreader member having a terminal edge extending in a closely spaced apart manner relative to the wall to help define an opening;

using a porous member disposed downstream of the spreader member near the opening, and positioning it inclined from the wall toward the central axis of said second duct means, permitting the air under pressure to flow through the porous member and then through the opening to flow in a direction opposite to the flow of material along the path;

permitting the reverse flow of the granular material away from the wall defining the outer periphery of the path and toward the center of the second duct means and for substantially preventing the granular material from entering said chamber;

directing the flow of the granular material out of the second duct means; and directing the flow of air and airborne debris contained therein out of the first duct means.

* * * * *